US005870008A

United States Patent [19]

Pannenborg et al.

[11] Patent Number: 5,870,008

[45] Date of Patent: Feb. 9, 1999

[54] RESIDENTIAL CIRCUIT BREAKER HAVING AN ENHANCED THERMAL-MAGNETIC TRIP UNIT

[75] Inventors: Erich J. Pannenborg, Southington; Gary P. Michaelis, Oakville; Andre J. M'Sadoques, Southington; Robert Casagrande, Oxford, all of Conn.

[73] Assignee: General Electric Company, Schnectady, N.Y.

[21] Appl. No.: 804,045

[22] Filed: Feb. 21, 1997

[51] Int. Cl.[6] ..... H01H 75/12

[52] U.S. Cl. ..... 335/35; 335/172; 335/173; 335/36; 335/37; 335/21

[58] Field of Search ..... 335/35–37, 21, 335/172, 173, 6

[56] References Cited

U.S. PATENT DOCUMENTS

| | | | |
|---|---|---|---|
| 3,317,867 | 5/1967 | Powell | 335/37 |
| 4,513,268 | 4/1985 | Seymour et al. | 335/35 |
| 4,616,199 | 10/1986 | Oster | 335/35 |
| 5,173,674 | 12/1992 | Pannenborg et al. | 335/35 |
| 5,182,532 | 1/1993 | Klein | 335/35 |
| 5,250,918 | 10/1993 | Edds et al. | 335/35 |
| 5,319,166 | 6/1994 | Arnold et al. | 200/17 R |
| 5,446,431 | 8/1995 | Leach et al. | 335/18 |

*Primary Examiner*—Michael L. Gellner
*Assistant Examiner*—Tuyen T. Nguyen
*Attorney, Agent, or Firm*—Fishman, Dionne, Cantor & Colburn; Carl B. Horton

[57] ABSTRACT

A residential circuit breaker electromagnetic trip unit facilitates the assembly of the trip unit components by use of a pair of braid connectors for connection between the trip unit magnet and the circuit breaker contact arm. The trip unit bimetal is directly welded to the trip unit magnet and the braid connectors for reduction in material and labor costs. The contact arm and the magnet are shaped to present a parallel path connection between the contact arm and the magnet for close fit tolerance. The front surface of the magnet is configured to prevent magnetic adhesion between the magnet and the trip unit armature under intense short circuit overcurrent conditions.

6 Claims, 3 Drawing Sheets

RESIDENTIAL CIRCUIT BREAKER HAVING AN ENHANCED THERMAL-MAGNETIC TRIP UNIT

BACKGROUND OF THE INVENTION

Residential circuit breakers are described in U.S. Pat. No. 4,513,268 entitled "Automated Q-Line Circuit Breaker". The circuit breaker includes a thermal-magnetic trip unit that interrupts the circuit current upon occasion of so-called "instantaneous", "short time" and "long time" overcurrent conditions. The thermal response of the trip unit is provided by means of an extended bimetal, which is part of the circuit breaker internal current-carrying components, and is separate from the magnet that provides the trip unit magnetic response. The bimetal, in a sense, forms the primary winding of a current transformer with the magnet acting as the transformer core. A separately arranged armature unit responds to the magnetic flux generated by the magnet upon the occurrence of intense overcurrent faults to release the circuit breaker operating mechanism and thereby interrupt the circuit current.

Upon occurrence of severe overcurrent conditions, the close contact between the armature and the magnet induces a strong temporary magnetic holding flux within the armature which could prevent the armature from releasing from the magnet once the overcurrent fault has cleared.

The braid conductor that is welded to the bimetal must be carefully positioned during the assembly of the trip unit components to insure that the braid does not interfere with the movement of the armature during operation of the trip unit upon occurrence of an overcurrent condition of all magnitudes and the diameter of the braid must be sized to deter overheating and embattlement of the braid material.

The present invention improves over the performance of the state-of-the art circuit breaker described above by a reduction of the size of the trip unit components to insure cost savings as well as to control the inertia of the movable trip unit components. Further advantages are found in the shaping of the magnet as well as the movable contact arm to reduce material and labor costs while, at the same time, enhancing the overall trip unit response.

SUMMARY OF THE INVENTION

A residential circuit breaker electromagnetic trip unit includes a one-piece bimetal magnet arrangement that is joined to the one ends of a pair of braid conductors by a single weld. The contact arm and the magnet are shaped to allow connection between the contact arm and the magnet by the braid conductors at the other ends. The armature interface surface of the magnet is configured to prevent magnetic adherence between the magnet and the armature under severe short circuit overcurrent conditions.

DESCRIPTION OF THE PREFERRED EMBODIMENT

Figure 1:
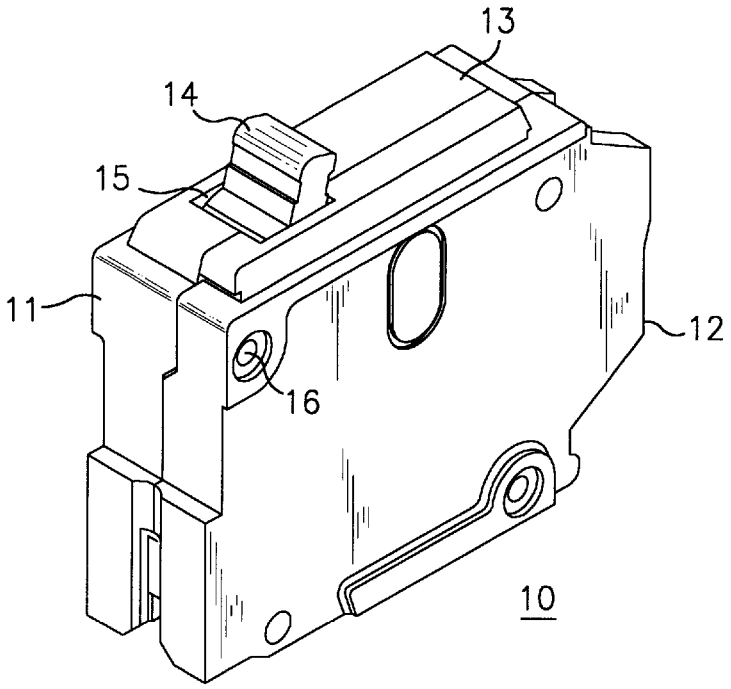
FIG. 1 is a top perspective view of a residential circuit breaker employing the electromagnetic-magnetic trip unit according to the invention.

A residential circuit breaker 10, similar to that described within the aforementioned U.S. Pat. No. 4,513,268, is shown in FIG. 1 to include a molded plastic case 11 to which a molded plastic cover 12 is attached by means of rivets 16. An escutcheon 13 is formed on the top of the circuit breaker and includes an access slot 15 for projection of the external handle operator 14 to allow for manual operation of the external circuit breaker operating components to turn the circuit breaker between ON and OFF conditions, as well as to reset the circuit breaker components upon clearance of a fault occurrence within a protected circuit.

Figure 2:
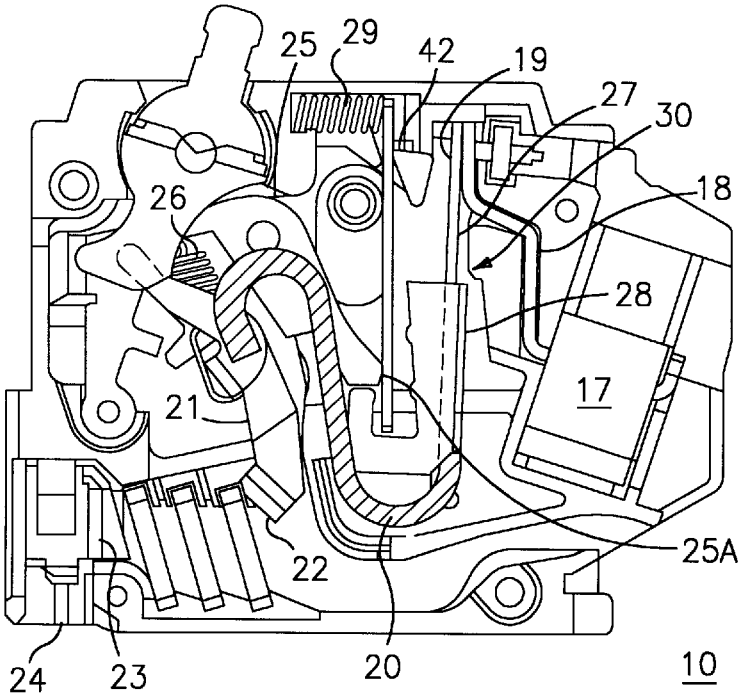
FIG. 2 is a side plan view of the circuit breaker of FIG. 1 with the cover removed to depict the circuit breaker internal components.

In accordance with the invention, a modular thermal-magnetic trip unit 30, hereinafter "modular trip unit", is depicted within the circuit breaker 10, shown in FIG. 2, for the purposes of detecting overcurrent conditions through the electric path beginning at the load lug 17, at one end, and terminating at the line stab 24 at the opposite end. The current proceeds from the load strap 18, through the bimetal 19, braid conductors 20, movable contact arm 21, movable contact 22 and fixed contact 23. During such transport, the current is thermally sensed by means of the bimetal 19 and magnetically sensed by means of the magnet 28 whereby the armature 27 rotates about the pivot tab 42 against the return bias of the armature spring 29 to release the cradle hook 25A at the end of the cradle 25 to allow rotation of the movable contact arm 21 to separate the movable and fixed contacts 22 ,23 under the urgence of the powerful operating spring 26.

Figure 3:
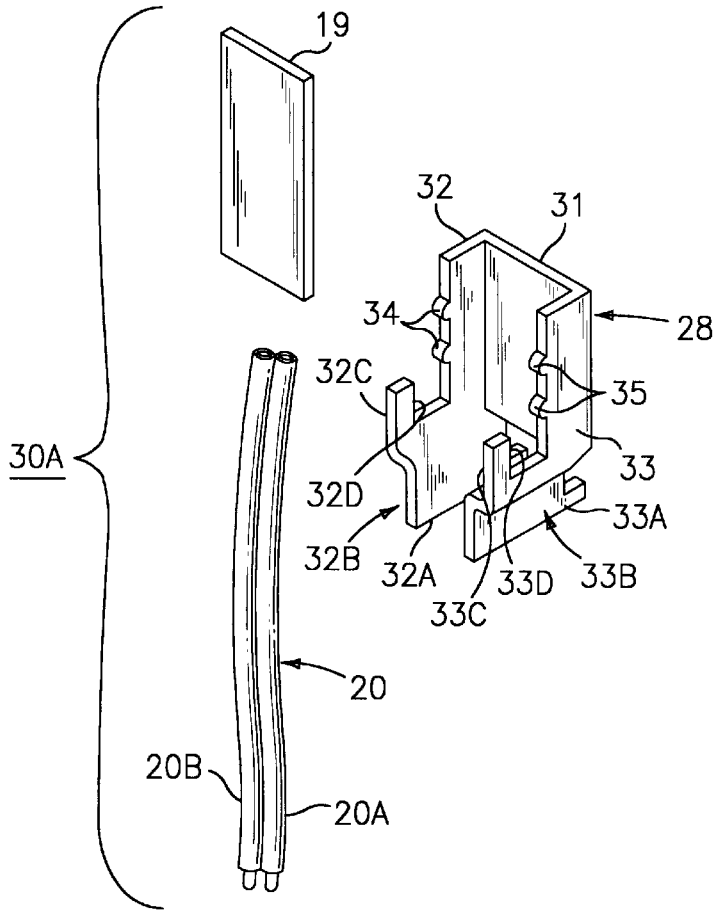
FIG. 3 is a top perspective view in isometric projection of a sub-assembly of the components used with the trip unit of FIG. 2.

The subassembly 30A that makes up part of the modular trip unit 30 (FIG. 2) is shown in FIG. 3 to include a quarter-sized bimetal 19 that is attached to the magnet 28 and to the braid conductor 20 that includes the adjoining pair of braid conductors 20A, 20B, as indicated. The magnet 28 is shaped from a magnetic steel plate to define a backwall 31, sidearms 32, 33 that define offset tabs 32A, 33A; shelves 32B, 33B; upstanding legs 32C, 33C; and slots 32D, 33D. A pair of protrusions 34, 35 are formed on the forward reaching edges of the legs 32C, 33C to focus the magnetic fields generated within the magnet 28 in the manner to be described below in some detail.

Figure 4:
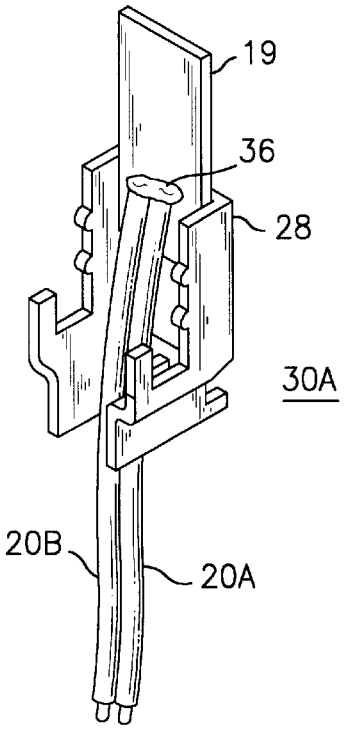
FIG. 4 is a front perspective view of the completed sub-assembly of FIG. 3.

The subassembly 30A is shown in FIG. 4 with the bimetal 19 attached to the ends of the braid conductors 20A, 20B as well as to the magnet 28 by means of a single weld as indicated at 36.

Figure 5:
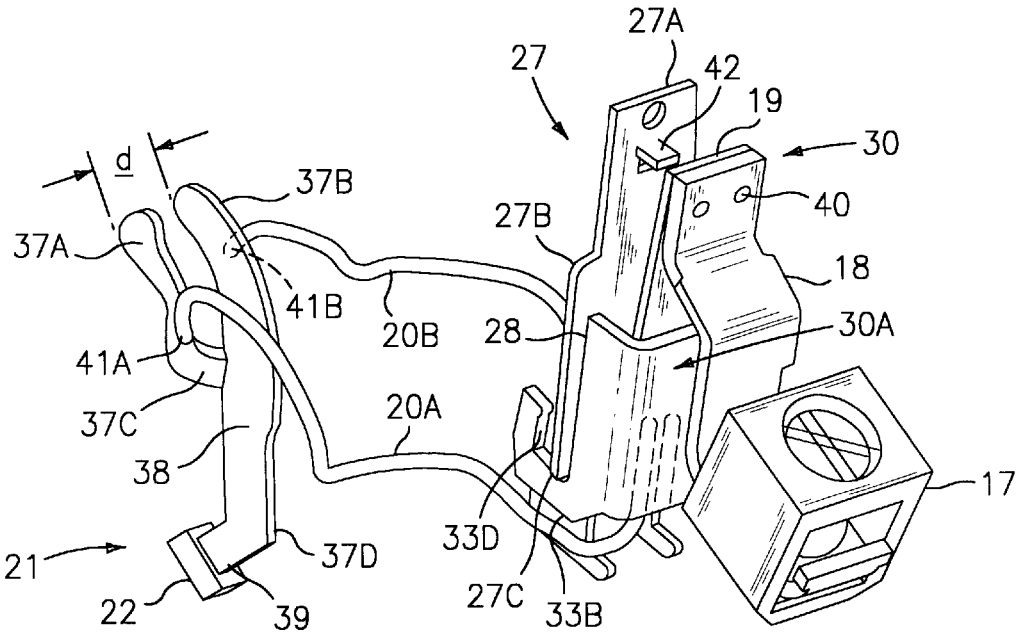
FIG. 5 is a top perspective view of the trip unit and contact arm assembly depicted in FIG. 2.
Figure 5A:
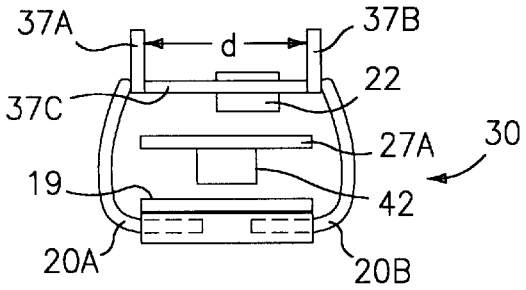

The connection between the modular trip unit 30 and the movable contact arm 21 is best seen by now referring to the arrangement depicted in FIG. 5 as follows. The load strap 18 is captured within the load lug 17, at one end, and is welded to the top of the bimetal 19 as indicated at 40. The armature 27 is arranged on the subassembly 30A and is positioned such that the top part 27A containing the tab 42 is coextensive with the width of the bimetal 19 while the wider bottom part 27B is coextensive with or wider than the magnet 28. The bottom 27C of the armature 27 sits within the slots 32D, 33D formed within the magnet 28 as described earlier with reference to FIG. 3. In further accordance with the teachings of the invention, the braid conductors 20A, 20B are positioned on opposite sides of the magnet 28 by positioning the braids within the shelves 33A, 33B formed on the bottom of the magnet as also shown in the aforementioned FIG. 3. The opposite ends of the braid conductors 20A, 20B are welded to the opposing sidearm 37A, 37B of the movable contact arm 21 as indicated at 41A, 41B respectively. The sidearms are separated by means of cross arm 37C to define a distance d to center the movable contact 22 which is attached to the tab 39 formed on the bottom of the contact arm 21. The bottom leg 37D of the contact arm includes an offset as indicated at 38 to center the movable contact accordingly.

Figure 6:
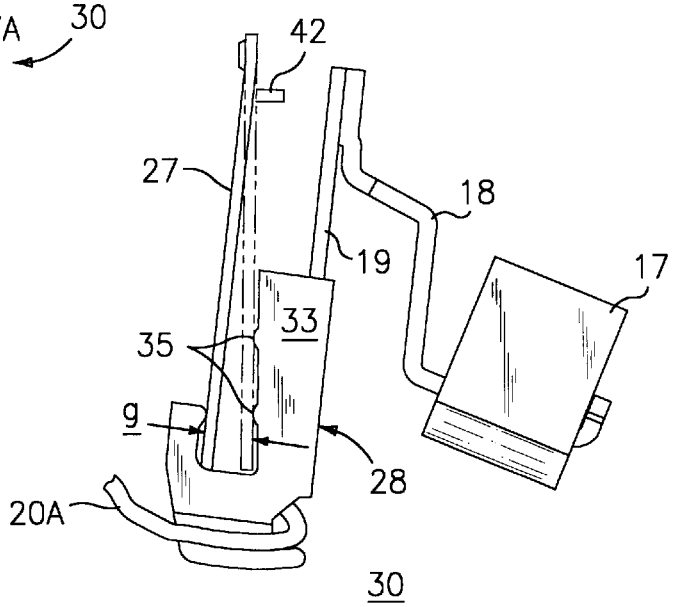
FIG. 6 is a side plan view of the trip unit of FIG. 2 depicting the armature during quiescent and overcurrent conditions.

The modular trip unit 30 is shown in FIG. 6 connecting with the load lug 17, load strap 18, bimetal 19 and braid conductor 20A to illustrate the current path through the modular trip unit as viewed from one side of the magnet 28. Although one sidearm 33 with corresponding protrusions 35 are seen herein, it is understood that the opposite sidearm 34 and protrusions 34 shown in FIG. 3 are present on the distal side of the magnet 28. When the trip unit is inserted within the circuit breaker 10, shown in FIG. 2, the armature spring 29 rotates the armature 27 about the pivot tab 42 to the so-called "quiescent" position indicated in solid lines in FIG. 6. As the current transfers through the bimetal 19 to generate electromagnetic forces on the armature 27 by passage through the magnet 28, the magnetic forces become directed toward the armature across the gap g defined between the opposing faces of the armature 27 and the sidearms 32, 33. The protrusions 34, 35 extend within the gap and become the closest part of the magnet 28 (FIG. 3) relative to the armature 27. The flux generated within the magnet 28 becomes concentrated or "focused" on the protrusions 34, 35 thereby driving the magnetic flux density within the protrusions to a high value. By the time the current has increased, the flux generated between the opposing surfaces of the sidearms 32, 33 and the armature 27 to rotate the armature about the pivot tab 42 into contact with the protrusions 34, 35, as shown in phantom, the iron magnetic material within the protrusions has become saturated such that the resulting magnetic flux then drops to a low value. When the circuit breaker operating handle 14 within the circuit breaker 10 of FIG. 1 is next is next moved from the OFF to the ON positions to reset the cradle hook 25A within the armature 27, as shown in FIG. 2, the armature 27 readily separates from the protrusions 34, 35 to rotate back to the quiescent position shown in solid lines in FIG. 6.

A modular electromagnetic trip unit has herein been described having several advantageous features. The unitary arrangement of the quarter-sized bimetal, optimally shaped magnet and off-set movable contact arm has resulted in substantial savings in materials and labor.

We claim:

1. A molded case circuit breaker comprising:

a plastic case and cover defining a circuit breaker enclosure;

a pair of fixed and moveable contacts within said enclosure, said moveable contact being arranged at one end of a moveable contact arm;

a cradle within said enclosure interacting with said contact arm to move said contact arm and movable contact away from said fixed contact to interrupt circuit current under the urgence of a powerful operating spring;

a thermal-magnetic trip unit within said enclosure interacting with said cradle, said thermal-magnetic trip unit comprising a bimetal and a magnet, said magnet comprising a shaped metal plate defining a back wall with a pair of sidearms extending in a forward direction from said back wall, said magnet including a protrusion extending from a forward edge of each of said sidearms; and an armature interacting between said magnet and said cradle, said armature pivotly mounted within said enclosure at a pivot tab a predetermined distance from said protrusions whereby said armature pivots about said pivot tab toward said magnet and contacts said protrusions to release said cradle upon occurance of circuit current in excess of a predetermined value.

2. The molded case circuit breaker of claim 1 wherein said sidearms comprise first and second opposing U-shaped arms defining first and second opposing U-shaped slots, a bottom edge of said armature being retained within said first and second slots.

3. The molded case circuit breaker of claim 2 further including first and second braid conductors attached to said bimetal and to said contact arm for providing a parallel electric path between said bimetal and said contact arm.

4. The molded case circuit breaker of claim 3 wherein a bottom part of said arms on opposite sides of said magnet are off-set to define a pair of first and second shelves, said first braid conductor being arranged proximate said first shelf and said second braid conductor being arranged proximate said second shelf.

5. A molded case circuit breaker comprising:

a plastic case and cover defining a circuit breaker enclosure;

a pair of fixed and movable contacts within said enclosure, said movable contact being arranged at one end of a movable contact arm;

a cradle within said enclosure interacting with said contact arm to move said contact arm and movable contact away from said fixed contact to interrupt circuit current under urgence of a powerful operating spring;

a thermal-magnetic trip unit within said enclosure interacting with said cradle, said thermal-magnetic trip unit comprising a bimetal and a magnet;

an armature interacting between said magnet and said cradle, whereby said armature moves toward said magnet to release said cradle upon occurrence of circuit current in excess of a predetermined value; and a first and a second braid conductor connecting between said bimetal and said movable contact arm for providing a parallel electric path between said bimetal and said contact arm, said contact arm being shaped to define a pair of first and second sidearms upstanding from a bottom leg, said movable contact being attached to an end of said bottom leg whereby said first braid conductor is attached to said first sidearm and said second braid conductor is attached to said second sidearm.

6. The molded case circuit breaker of claim 5 wherein said first and second sidearm are separated by a predetermined distance to thereby position said movable contact in a plane intermediate said first and second sidearms.

* * * * *